United States Patent [19]

Hookings et al.

[11] 4,047,419

[45] Sept. 13, 1977

[54] METHOD AND APPARATUS FOR EXPANDING SPIRALWELD PIPE

[75] Inventors: Paul H. Hookings, Ridgeville; Harry C. Wade; Phillip Deijs, both of Welland, all of Canada

[73] Assignee: The Steel Company of Canada, Limited, Hamilton, Canada

[21] Appl. No.: 698,964

[22] Filed: June 23, 1976

[30] Foreign Application Priority Data

Apr. 30, 1976 Canada ..... 251515

[51] Int. Cl.[2] ..... B21B 17/02

[52] U.S. Cl. ..... 72/370; 72/393

[58] Field of Search ..... 72/393, 392, 465, 370, 72/368, 367, 37, 150; 269/48.1; 219/62; 228/17, 17.5, 17.7, 141, 143; 356/156, 159, 167, 168, 170, 172; 29/407

[56] References Cited

U.S. PATENT DOCUMENTS

| | | | |
|---|---|---|---|
| 3,503,245 | 3/1970 | Brandl | 72/37 |
| 3,981,172 | 9/1976 | Hess et al. | 72/393 |

*Primary Examiner*—James R. Duzan

*Attorney, Agent, or Firm*—Sim & McBurney

[57] ABSTRACT

This invention provides a method and apparatus for expanding spiralweld pipe. The expander head is cantilevered at a fixed location and the spiralweld pipe is advanced in stages around the expander head, moving in the direction of the pipe axis. At each stage, the pipe is stopped, and the expander head is expanded to cause expansion in the pipe. The expander head has on its surface a helically arranged recess matching the main weld of the pipe. As the pipe is moved between adjacent expansion locations, it undergoes axial and rotational motion so that the main weld tracks in registry with the recess.

7 Claims, 4 Drawing Figures

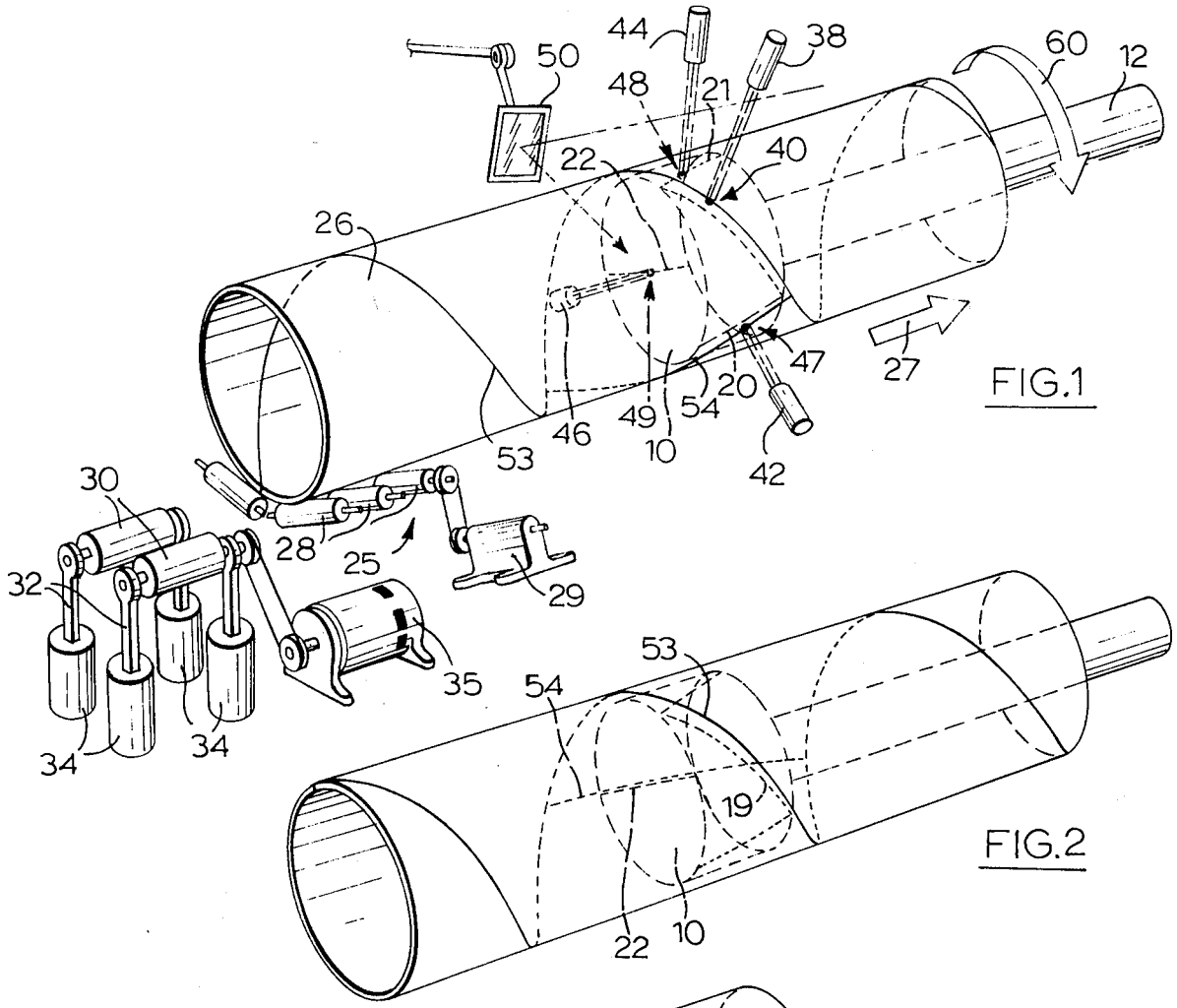
FIG.1
FIG.2
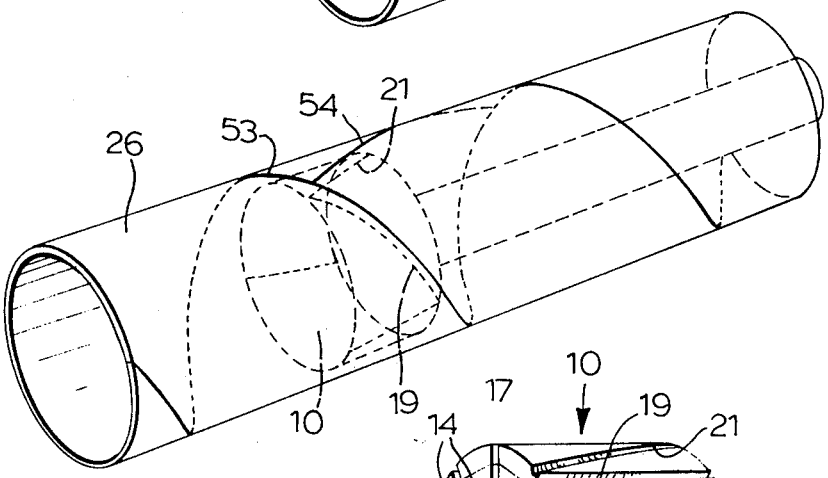
FIG.3
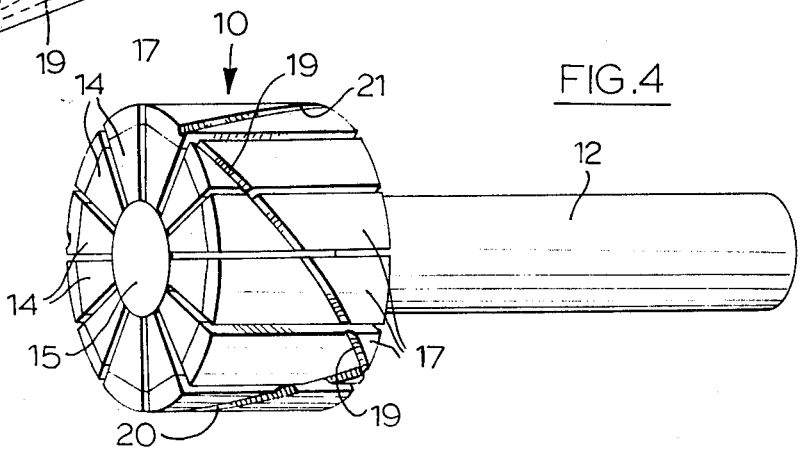
FIG.4

METHOD AND APPARATUS FOR EXPANDING SPIRALWELD PIPE

This invention relates generally to the mechanical expansion of relatively large-diameter pipe in order to improve the yield properties of the pipe.

One of the primary reasons for carrying out expansion of previously formed pipe is to increase the minimum yield point for the steel in the pipe wall. Conventional practice in the area of pipes formed by the practice known as U-ing and 0-ing involves the provision of a conventional expander head having a plurality of radially expansible shoes, each having a part-cylindrical surface exactly conforming to the curvature of the final diameter of the pipe to be expanded. The shoes are supported by the expander head, and the latter is ordinarily cantilevered above a roller bed from a point which is a substantial distance away from the head in the longitudinal direction of the bed. Conventionally, the expander head operates on the principle of sliding wedges having contact along sloping faces, with one of the components of each pair of wedges being restrained against axial movement, while the other component is moved axially so as to drive the longitudinally restrained component outwardly. This carries all of the shoes radially outwardly simultaneously. The previously formed pipe is carried on the roller bed so as to enclose the roller head and move past it. The roller bed includes drive rollers, and a control mechanism is provided which is capable of moving the pipe sequentially between progressive stationary locations, so that the expander head comes adjacent sequential sections of the pipe. At each arrested location of the pipe, the expander head is caused to expand in order to increase the diameter of the pipe at that particular section, and then the expander head is collapsed to permit the pipe to move to the next stationary location. Where this practice is carried out with pipes made by U-ing and O-ing, the pipe itself has a longitudinal seam weld, and a portion of the weld typically projects inwardly to a point inside the inner surface of the pipe. In order to accommodate and allow for this inwardly projecting seam weld, one of the expander shoes is provided with a longitudinal recess or groove across its face, which is adapted to be aligned with the longitudinal seam weld, whereby the seam weld can enter into the groove during the expansion process. Failure to provide such a recess or groove would mean that the outward pressure exerted by the expander head would be applied very strongly against the seam weld itself, causing stress concentration at that location, and very possibly causing cracks or ruptures at the location of the weld.

In the case of spiralweld pipe, the area to which this invention particularly pertains, the major seam progresses in a helix around the pipe, with cross welds located at intervals and representing the length of the individual plates utilized to form the spiralweld pipe. For spiralweld pipe, an expander head having a longitudinal recess is not appropriate, because the helically oriented weld cannot be made to align itself with the longitudinal recess.

Accordingly, it is an aspect of this invention to provide a method and apparatus for expanding a spiralweld pipe utilizing an expander head having radially outwardly movable shoes, such that it is not necessary to grind off the inwardly projecting weld seam prior to expansion in order to eliminate the risk of cracking or rupture of the weld due to stress concentration.

Accordingly, this invention provides a method of expanding a spiralweld pipe having transverse welds at intervals, comprising the steps:

supporting at a fixed location an expander head having a helically arranged recess matching the helical weld of the pipe, and at least one further recess disposed so as to be capable of alignment with a transverse weld of the pipe, sequentially and incrementally advancing the pipe around the expander head in the direction of the pipe axis through a plurality of stationary locations at which movement is arrested, the movement of the pipe between each sequential pair of locations including both axial and rotational motion such that the helical weld tracks in registry with said recess, the arresting of pipe movement being accomplished such that whenever any part of a transverse weld comes to a halt adjacent the expander head it is in registry with the said at least one further recess, the latter step including the provision of visible indicator means adapted to show at the exterior of the pipe the location of all said recesses, thereby to facilitate the alignment of welds with the respective recesses, and expanding said expander head against the inside of the pipe at each said stationary location.

This invention further provides apparatus for expanding a spiralweld pipe having transverse welds at intervals, comprising:

an expander head having a helically arranged recess matching the helical weld of the pipe, and at least one further recess disposed so as to be capable of alignment with a transverse weld of the pipe, support means for supporting the expander head at a fixed location, feed means for advancing the pipe around the expander head in the direction of the pipe axis and for sequentially arresting the pipe at a plurality of locations, said feed means being capable of moving the pipe both axially and rotationally to cause the helical weld to track in registry with said recess, stationary means external of the pipe adapted to provide against the pipe periphery a visible indication of the positions of all said recesses, thereby to facilitate the alignment of welds with the respective recesses, and powered means for expanding said expander head against the inside of the pipe at each said location.

Throughout the remainder of this specification and in the appended claims, the word "spiralweld" will be utilized only in the expression 'spiralweld pipe'. The latter expression is the standard designation in the trade for pipe having its major seam progressing helically around its periphery. Elsewhere in the specification and claims, however, the words 'helix' and 'helical' will be employed to identify the seam of the pipe and the recess in the head, since the shape of the seam is a true helix and not a spiral.

One embodiment of this invention is illustrated in the accompanying drawings, in which like numerals denote like parts throughout the several views, and in which:

FIGS. 1, 2 and 3 are sequential perspective views of a spiralweld pipe being expanded by the apparatus of this invention; and FIG. 4 is a perspective view of an expander head constructed in accordance with this invention.

Attention is first directed to FIG. 4, which shows an expander head 10 supported on a cantilevered column 12.

The expander head 10 consists of a plurality of wedge elements 14 arranged circumferentially around a central hub 15, and supporting outwardly a plurality of expander shoes 17, each having a part-cylindrical outer surface conforming to the curvature of the pipe after it has been expanded. The mechanism by which the wedge members 14 are caused to move radially outwardly from the hub 15 is not illustrated, as this is entirely conventional and does not lie at the focus of this invention.

The expander head 10 is provided with a helical recess 19 which spans across four of the expander shoes 17, as can be seen in FIG. 4. The helical recess 19 is made to conform exactly to the helical seam weld of the pipe which is to be expanded by the expander head. Because the expander shoes 17 are removable and replaceable, it will be understood that it is possible to alter the expander head 10 to accommodate a large number of different helices (i.e. helical seam welds having different angles to the axis of the pipe). Additionally, the expander head 10 shown in FIG. 4 is provided with three further recesses 20, 21 and 22, these all being oriented transversely to the helical recess 19. The word "transversely" may suggest some problem in connection with a cylindrical surface, but if it is imagined that the cylindrical surface of the expander 10 were developed, i.e. flattened out into a flat surface, it would be realized that the helical recess 19 would become a straight line on the developed flat surface. Also on this developed flat surface, the further recesses 20, 21 and 22 would be oriented normally to the recess 19. As such, it will be understood that the further recesses 20, 21 and 22 will all be parallel to the tranverse welds which are encountered in spiralweld pipe, the transverse welds representing the end edges of the elongated flat plates utilized to form the spiralweld pipe. These end edges are always at right-angles to the side edges, which is why the further recesses 20, 21 and 22 must be oriented perpendicularly to the recess 19.

Attention is now directed to FIGS. 1, 2 and 3, for a description of the process of this invention.

FIG. 1 illustrates a roller bed 25 which supports a section of spiralweld pipe 26 for longitudinal movement in the direction of arrow 27. In the embodiment illustrated, one of the rollers 28 constituting the roller bed 25 is adapted to be positively driven by a motor 29, in order to move the section of spiralweld pipe 26 selectively forward or rearward.

Also shown in FIG. 1 are two turning rollers 30 which are in and form part of the roller bed 25, but are arranged with their axes parallel with the axis of the pipe 26. The turning rollers 30 are supported in the ends of piston rods 32 of cylinders 34, the latter being adapted to be simultaneously extended in order to raise the turning cylinders 30 from a position in which they lie below the outer surface of the pipe 26, to one in which they bear upwardly against the pipe 26 and in effect lift the pipe 26 off the rollers 28 a slight distance. Once the pipe 26 has been raised off the transverse rollers 28, one of the turning rollers 30 is energized by means such as the motor 35 in order to rotate the pipe 26 about its axis. The motor 35 is reversible and can be utilized to rotate the pipe 26 by very small increments, for purposes of alignment, as will subsequently appear.

It will thus be understood that feed means are provided for advancing the pipe along the roller bed in the direction of the pipe axis and for sequentially arresting the pipe at a plurality of stationary locations. The feed means illustrated and described with respect to FIG. 1 are thus capable of moving the pipe both axially and rotationally, in a selective manner.

Also illustrated in FIG. 1 (although not in as great detail as in FIG. 4), is the expander head 10 and the cantilever arm 12. The separations between the individual shoes 17 have not been shown in FIG. 1 for simplicity, but lines are provided on the cylindrical surface of the expander head 10 to show the position of the helical recess 19, and the further recesses 20, 21 and 22.

A first light source 38 is provided at a location which is outside of the pipe 26 and is fixed with respect to the expander head 10, it being understood that the expander head 10 is firmly and fixedly supported by means of the cantilever arm 12 in a position in which it is stationary with respect to the roller bed 25. Thus, all parts are stationary except for the moving pipe 26 (and except for the outward motion of the expander shoes 17 when the expander head is activated). The first light source 38 is adapted to project a narrow beam of light against the pipe periphery to produce a first spot 40 against the outer surface of the pipe 26, the spot being aligned with the helical recess 19 in the expander head 10.

Also illustrated in FIG. 1 are three further light sources 42, 44 and 46 (the latter illustrated in broken lines). Each of these further light sources 42, 44 and 46 is fixed at a location outside of the pipe 26 and is stationary with respect to the expander head 10, and each source is adapted to project its own narrow beam of light against the pipe periphery to produce a further spot of light thereon which is aligned with one of the recesses 20, 21 and 22 on the expander head 10. The spots of light are identified by the numerals 47, 48 and 49.

A mirror or other reflective means 50 is provided at a fixed location outside of the pipe 26 adjacent the position of the expander head 10, for a purpose which will appear subsequently.

The basic method of this invention involves the steps of sequentially advancing the pipe 26 around the expander head 10 in the direction of the pipe axis through a plurality of stationary locations. The rollers described earlier are utilized to ensure that the movement of the pipe between each sequential pair of stationary locations includes both axial and rotational motion of the pipe in order that the helical weld 53 tracks in registry with the recess 19 on the expander head 10. At each stationary location, the expander head is expanded against the inside of the pipe 26. It will be understood that, for a given axial dimention of expander head 10, the distance of movement of the pipe between any two sequential stationary locations would be not greater than such longitudinal dimension.

In the particular embodiment illustrated, the pitch of the helical seam weld 53 amounts to three times the axial dimension of the expander head 10, and it is for this reason that the expander head is provided with three further recesses 20, 21 and 22 as will hereinafter appear.

Before proceeding further, it should be pointed out that the illustrations in FIG. 1, 2 and 3 have been drawn on the assumption that the pipe 26 is completely transparent (as if made of glass), in order that the expander head 10 can be illustrated without having to use broken lines. The use of broken lines to show all portions of the expander head 10 would result in considerable confusion due to the arrangement of the different helices, curves, etc. Although the expander head 10 has been shown in solid lines, all portions of both the pipe 26 and the expander head 10 which are on the far side as viewed in the figures are shown in broken lines. This is to avoid confusion in connection with the way in which the spiralweld 53 tracks around the pipe 26.

The section of the spiralweld pipe illustrated in FIG. 1 includes one transverse weld 54, about half of which is visible on the near side of the pipe adjacent the location of the expander head 10, the other half of which is shown in broken lines as it lies on the far side of the pipe 26 and would not be visible if the pipe were opaque.

A tranverse weld such as the transverse weld 54 comes adjacent the expander head 10 only at intervals, and this does not occur at every stationary location of the pipe 26. The percentage of operation time during which a transverse weld is found adjacent the expander head 10 depends upon the dimensions of the pipe, the length of the plate utilized to make the pipe, the pitch of the weld, and other factors. Whenever there is no transverse weld adjacent the expander head 10, the only alignment which is essential is the alignment between the helical weld 53 and the helical recess 19. However, when a transverse weld comes adjacent the expander head 10, it is essential also to align the appropriate portion of the transverse weld with one of the further recesses 20, 21 or 22, in order to avoid excessive stress concentration at the weld due to being contacted by the shoes of the expander head.

FIG. 1 shows the first third of the transverse weld 54 adjacent the further recess 20, while at the same time the helical seam 53 is aligned with the helical recess 19 in the expander head 10. FIG. 1 represents a stationary location for the pipe 26, at which the expander head would be activated to expand the pipe wall. The welds during this process will register with the appropriate recesses, and will not be subject to high stress concentration.

After this expansion has taken place, the expander head 10 is again contracted, and the appropriate rollers are activated in order to move the pipe forwardly in the direction of arrow 27, and rotationally in the direction of arrow 60, in order to ensure that, when the pipe is in the next stationary location, the helical seam 53 continues to be aligned with the helical recess 19, and the transverse seam 54 has moved in the clockwise direction around the pipe (looking in the direction of movement) to arrive at the recess 22, as illustrated in FIG. 2. The light sources, the mirror and the rollers have not been illustrated in FIG. 2, in order to avoid cluttering the drawing. In the stationary location represented by FIG. 2, the expander head 10 is again expanded in order to increase the diameter of the pipe wall. It will now be understood that the pipe, in moving from the position of FIG. 1 to that of FIG. 2, will move substantially exactly the same distance as the axial dimension of the expander head 10. This is so because, as mentioned previously, the expander head 10 has an axial dimension which is one-third of the pitch of the helical seam 53, and because the recesses 20, 21 and 22 are located 120° away from each other around the circumference of the expander head 10.

After the expander head has been expanded and contracted in the FIG. 2 location, the pipe is again moved rightwardly to the location represented by FIG. 3, in which the helical seam 53 is still aligned with the recess 19, and in which the transverse weld 54 has now come around a further 120° to be aligned with the recess 21. Since all of the seams that would be contacted by the expanding expander head 10 are in registry with suitable recesses, the expander head 10 can be activated without producing stress concentration at these welded seams.

It will now be understood tha the next stationary location for the pipe 26 after that of FIG. 3 will be one in which the transverse weld 54 has moved rightwardly beyond the expander head 10. In such location, the problem of allowing for the transverse weld does not arise, and it is necessary only to ensure that the helical seam 53 is in alignment with the helical recess 19.

The spots of light 40, 47, 48 and 49 are projected on the outer surface of the pipe 26 in order to allow the operator to know when the helical or transverse welds (as the case may be) are in alignment with the recesses in the expander head 10. The beams of light from the light sources are such that, if the pipe were not in the way, the point of light would fall exactly within the appropriate recess.

The mirror 50 is provided to allow an operator on the nearer side of the apparatus as illustrated in FIG. 1 to view the spot 49.

It will be understood that the pipe may be moved by the appropriate rollers with two independent movements, one being a longitudinal movement and the other being a rotational movement. On the other hand, angulated rollers could be provided which simultaneously moved the pipe 26 both forwardly and rotationally, in order to keep the helical seam 53 tracking true, always remaining in registry with the helical recess 19 in the expander head 10.

It will be further understood that the expander head 10 could be provided with one, two, four or any number of the additional recesses adapted to receive a transverse weld when such comes adjacent the expander head. The number provided will depend on design considerations, but typically would be a number equal to the number of times the axial dimension of the expander head 10 divides into the pitch of the helical seam 53.

We claim:

1. A method of expanding a spiralweld pipe having transverse welds at intervals, comprising the steps:

supporting at a fixed location an expander head having a helically arranged recess matching the helical weld of the pipe, and at least one further recess disposed so as to be capable of alignment with a transverse weld of the pipe, sequentially and incrementally advancing the pipe around the expander head in the direction of the pipe axis through a plurality of stationary locations at which movement is arrested, the movement of the pipe between each sequential pair of locations including both axial and rotational motion such that the helical weld tracks in registry with said recess, the arresting of pipe movement being accomplished such that whenever any part of a transverse weld comes to a halt adjacent the expander head it is in registry with the said at least one further recess, the latter step including the provision of visible indicator means adapted to show at the exterior of the pipe the location of all said recesses, thereby to facilitate the alignment of welds with the respective recesses, and expanding said expander head against the inside of the pipe at each said stationary location.

2. The method claimed in claim 1, in which the expander head has at least one further recess disposed so as to be capable of alignment with a transverse weld of the pipe, the method including aligning each transverse weld, as it arrives adjacent the expander head, with said further recess.

3. The method claimed in claim 1, in which the axial length of a transverse weld measured parallel to the pipe axis is substantially a whole number of times as great as the axial length of the head, and in which the number of said further recesses around the circumference of the head is the same as the said number of times.

4. The method claimed in claim 3, in which said provision of visible indicator means is accomplished by: directing a narrow light beam against the pipe periphery from a fixed light source outside the pipe to produce a first spot of light which is aligned with the spiral recess in the head; for each said further recess directing an additional narrow light beam against the pipe periphery from an additional light source to produce an additional spot of light which is aligned with the respective further recess in the head; and using all said spots of light to ensure that the spiral weld of the pipe remains in registry with the spiral recess, and that the transverse welds, when they come adjacent the head, are in registry with one of said further recesses when the head is expanded.

5. Apparatus for expanding a spiralweld pipe having transverse welds at intervals, comprising:

an expander head having a helically arranged recess matching the helical weld of the pipe, and at least one further recess disposed so as to be capable of alignment with a transverse weld of the pipe, support means for supporting the expander head at a fixed location, feed means for advancing the pipe around the expander head in the direction of the pipe axis and for sequentially arresting the pipe at a plurality of locations, said feed means being capable of moving the pipe both axially and rotationally to cause the helical weld to track in registry with said recess, stationary means external of the pipe adapted to provide against the pipe periphery a visible indication of the positions of all said recesses, thereby to facilitate the alignment of welds with the respective recesses, and powered means for expanding said expander head against the inside of the pipe at each said location.

6. The invention claimed in claim 5, in which said stationary means includes: a) at a location outside of the pipe and fixed with respect to the expander head a first light source for projecting a narrow beam of light against the pipe periphery to produce a first spot of light thereon which is aligned with the spiral recess in the head; and b) for each said further recess on the head a further light source at a location outside of the pipe and fixed with respect to the expander head, said further light source being adapted to project a narrow beam of light against the pipe periphery to produce a further spot of light thereon which is aligned with the respective further recess on the head.

7. The invention claimed in claim 5, in which there is further provided reflective means outside of the pipe, fixed with respect to the expander head, and located so as to permit an operator to view any spot or spots of light which may not, from the operator's position, be directly visible.

* * * * *